US007695325B2

(12) United States Patent
Asari et al.

(10) Patent No.: US 7,695,325 B2
(45) Date of Patent: Apr. 13, 2010

(54) CONNECTOR

(75) Inventors: Takako Asari, Yokkaichi (JP); Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/251,520

(22) Filed: Oct. 15, 2008

(65) Prior Publication Data

US 2009/0104808 A1 Apr. 23, 2009

(30) Foreign Application Priority Data

Oct. 19, 2007 (JP) ..... 2007-272911
Oct. 26, 2007 (JP) ..... 2007-279069

(51) Int. Cl.
*H01R 13/514* (2006.01)

(52) U.S. Cl. ..... 439/752

(58) Field of Classification Search ..... 439/752
See application file for complete search history.

(56) References Cited

U.S. PATENT DOCUMENTS 5,336,116 A 8/1994 Boteler
5,378,176 A 1/1995 Sasai
5,464,356 A * 11/1995 Nebeshima et al. ..... 439/752
6,358,102 B1 * 3/2002 Fukamachi ..... 439/752
7,001,215 B2 2/2006 Nakamura
7,182,652 B2 2/2007 Yamakado
2004/0076466 A1 4/2004 Nakamura

FOREIGN PATENT DOCUMENTS

DE 102004055444 A1 6/2004
GB 1190333 5/1970
WO 2005078870 8/2005

* cited by examiner

*Primary Examiner*—Ross N Gushi
(74) *Attorney, Agent, or Firm*—Gerald E. Hespos; Michael J. Porco

(57) ABSTRACT

An outer housing (10) includes a receptacle (12) projecting forward, and a connection space (14) is formed at a back end part of the receptacle (12). An inner housing (20) holding terminal fittings (50) is inserted into the receptacle (12) to be assembled with the outer housing (10) while being fitted in the connection space (14). Ribs (28*a*) to (28*g*) for preventing relative displacements of the inner housing (20) in directions intersecting with an assembling direction with respect to the receptacle (12) by coming into sliding contact with the inner circumferential surface of the receptacle (12) are formed on the outer circumferential surface of the inner housing (20).

14 Claims, 17 Drawing Sheets

CONNECTOR

BACKGROUND OF THE INVENTION

1. Field of the Invention

The invention relates to a connector.

2. Description of the Related Art

U.S. Pat. No. 7,001,215 discloses a connector constructed by combining an inner housing and an outer housing. Parts of male terminal fittings behind tabs are accommodated in terminal accommodating chambers formed in the inner housing, and the tabs project forward from the inner housing. A receptacle projects forward on the outer housing and a connection space is formed at a back end of the receptacle. The inner housing is inserted into the receptacle from the front and is fit into the connection space. The tabs are surrounded and protected by the receptacle when the inner and outer housings are assembled.

The inner housing of the above-described connector is smaller than the receptacle if the number of the terminals is small, and hence the connection space at the back side of the receptacle can be formed smaller than the receptacle. In this case, a large clearance is defined between the outer peripheral surface of the inner housing and the inner peripheral surface of the receptacle when the inner and outer housings are assembled. The connection space, into which the inner housing is fit, is difficult to see from the front due to its position at a back end of an injection nozzle. As a result, the inner housing may not be able to be fit successfully into the connection space.

U.S. Pat. No. 7,182,652 discloses a connector constructed so that terminal fittings are inserted into a housing from behind and are retained by a retainer mounted in the housing. The retainer is assembled in a direction orthogonal to an inserting direction of the terminal fittings into the housing. The retainer can be held at a partial locking position for permitting insertion of the terminal fittings and a full locking position for engaging and retaining the terminal fittings.

The terminal fittings are inserted in the connector of this type with the retainer held at the partial locking position. Thus, the retainer is held at the partial locking position while transporting the connector to a terminal fitting insertion site.

The retainer of the above-described connector is pushed deeply into the housing for movement from the partial locking position to the full locking position. There is a likelihood that the outer surface of the retainer will be pushed by another connector or the like during transportation to the terminal fitting insertion site and hence the retainer may be pushed prematurely to the full locking position. As a result, an extra operation is required for returning the retainer to the partial locking position before the insertion of the terminal fittings is necessary.

The invention was developed in view of the above situation, and an object thereof is to improve the operability of the connector.

SUMMARY OF THE INVENTION

The invention relates to a connector with an outer housing including a receptacle formed with a connection space at a back end part of the receptacle. An inner housing is inserted into the receptacle of the outer housing and is fit in the connection space. The inner housing is configured for holding one or more terminal fittings. Ribs are formed on the outer peripheral surface of the inner housing for sliding in contact with an inner peripheral surface of the receptacle for preventing relative displacements of the inner housing in directions intersecting an assembling direction with respect to the receptacle. Thus, the inner housing can be fit reliably into the connection space.

The ribs preferably extend substantially continuously and parallel with an assembling direction of the inner housing into the receptacle to prevent an oblique posture of the inner housing with respect to the assembling direction. Accordingly, the inner housing can be assembled into the outer housing more efficiently.

A retainer preferably is mounted in the inner housing to engage and retain the one or more terminal fittings. Part of the retainer preferably projects from the outer peripheral surface of the inner housing. The outer surface of a part of the retainer projecting from the inner housing can be held substantially in sliding contact with the inner peripheral surface of the receptacle. The inner housing is positioned utilizing both the ribs and the retainer. Thus, the number of ribs formed on the inner housing can be reduced and the shape of the outer peripheral surface of the inner housing can be simplified.

The inner housing preferably is a block having two outer surfaces substantially parallel to each other, the ribs are formed on one of the two outer surfaces of the inner housing, and the retainer projects from the other of the two outer surfaces of the inner housing. The orientation of the inner housing can be discriminated easily by confirming the positions of the ribs and the retainer. Thus, an operator will not insert the inner housing into the receptacle in an incorrect orientation.

The inner peripheral surface of the receptacle preferably has a substantially elliptical shape defined by connecting two semicircular surfaces by two substantially parallel flat surfaces. The retainer slides in contact with the flat surfaces. No ribs are formed on the outer surface of the inner housing, where the retainer projects. The inner housing is formed with two ribs for each semicircular surface that slide in contact with a quarter-circular area of the semicircular surface at a projecting side and a quarter-circular area of the semicircular surface at a side opposite to the retainer projecting side.

The inner and outer housings could shake relative to one another in directions substantially orthogonal to the flat surfaces if an assembling tolerance between the inner housing and the retainer is large. However, the ribs slide in contact with the quarter-circular areas of the semicircular surfaces at the retainer projecting side and those of the semicircular surfaces at the side opposite to the retainer projecting side. Accordingly, directions in which the ribs contact the two quarter-circular areas of one semicircular surface are opposite to each other with respect to the directions orthogonal to the flat surfaces. Therefore, there is no likelihood of backlashes of the inner housing and the retainer in the directions orthogonal to the flat surfaces.

The retainer that has been assembled in the housing can be positioned at a first position for permitting insertion of the terminal fittings. The retainer can then be moved to a second position for locking the terminal fittings A moving direction of the retainer between the first position and the second position intersects both the assembling direction of the retainer into the housing and the inserting direction of the terminal fittings into the housing. Accordingly, the retainer that has been assembled in a housing is not likely to be moved inadvertently from the first position to the second position.

An accommodation space preferably is formed in the housing for assembling the retainer. The housing also preferably includes at least one window-shaped opening for permitting the retainer to be assembled into the accommodation space in the direction intersecting the inserting direction of the terminal fittings.

The housing preferably includes guide means for guiding the retainer between the first and second positions. Thus, the retainer can be moved stably to improve overall operability of the connector.

The retainer preferably is shorter than the housing in the moving direction of the retainer from the first position to the second position.

With the retainer at the first position, an end of the retainer at a first position side in the moving direction of the retainer from the first position to the second position preferably is closer to a second position side than the outer surface of the housing. Thus, even if external matter approaches in a direction to move the retainer to the second position, this external matter does not contact the end of the retainer at the first position side. Therefore, external matter cannot push the retainer from the first position to the second position.

The housing preferably has at least one restriction for engaging the retainer to prevent separation of the retainer from the housing.

The restriction may have a first lock for holding the retainer at the first position and a second lock for holding the retainer at the second position. Thus, the shape of the housing is simplified as compared with the case where the first and/or second locks are formed on a part other than the restriction.

The housing preferably includes an inner housing into which the one or more terminal fittings are inserted and an outer housing for accommodating the inner housing.

The accommodation space for the retainer preferably is formed in the inner housing and opens in the outer peripheral surface of the inner housing. The accommodation space in the outer peripheral surface of the inner housing preferably is covered by the outer housing. Thus, external matter will not interfere with the retainer.

The outer surface of the retainer assembled in the inner housing preferably has a slide-contact surface that projects from the outer surface of the inner housing and has an area substantially parallel to the moving direction from the first position to the second position. Thus, the retainer can be moved stably from the first position to the second position while bringing the slide-contact surface into sliding contact with the inner surface of the outer housing.

The retainer preferably is formed with at least one operable portion that projects substantially forward from or near the front surface of the inner housing. A jig can be inserted into the outer housing from the front to engage the operable portion for moving the retainer from the first locking position to the second locking position.

These and other features of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

Figure 1:
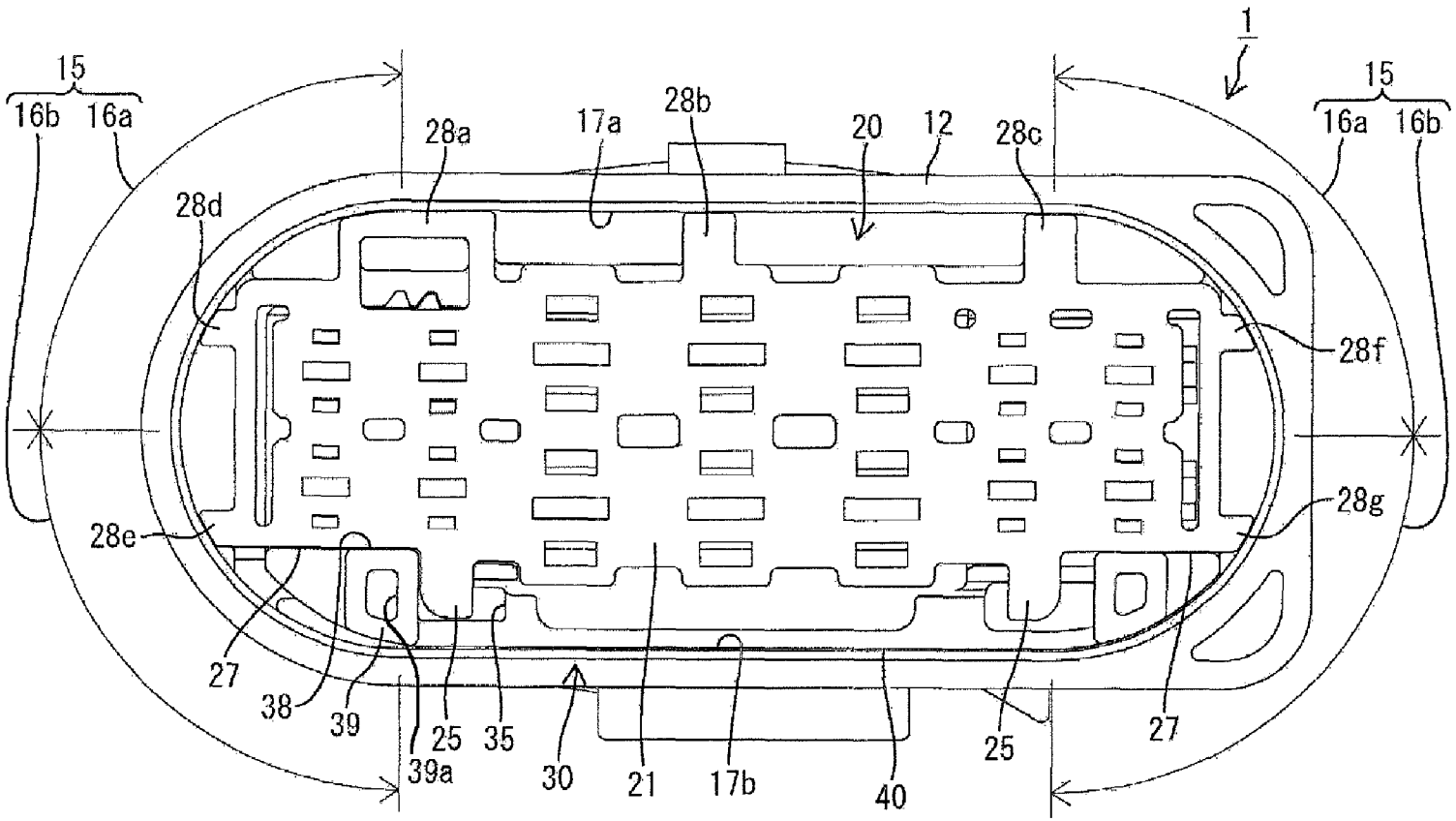
FIG. 1 is a front view of a first aspect of a preferred embodiment.
Figure 2:
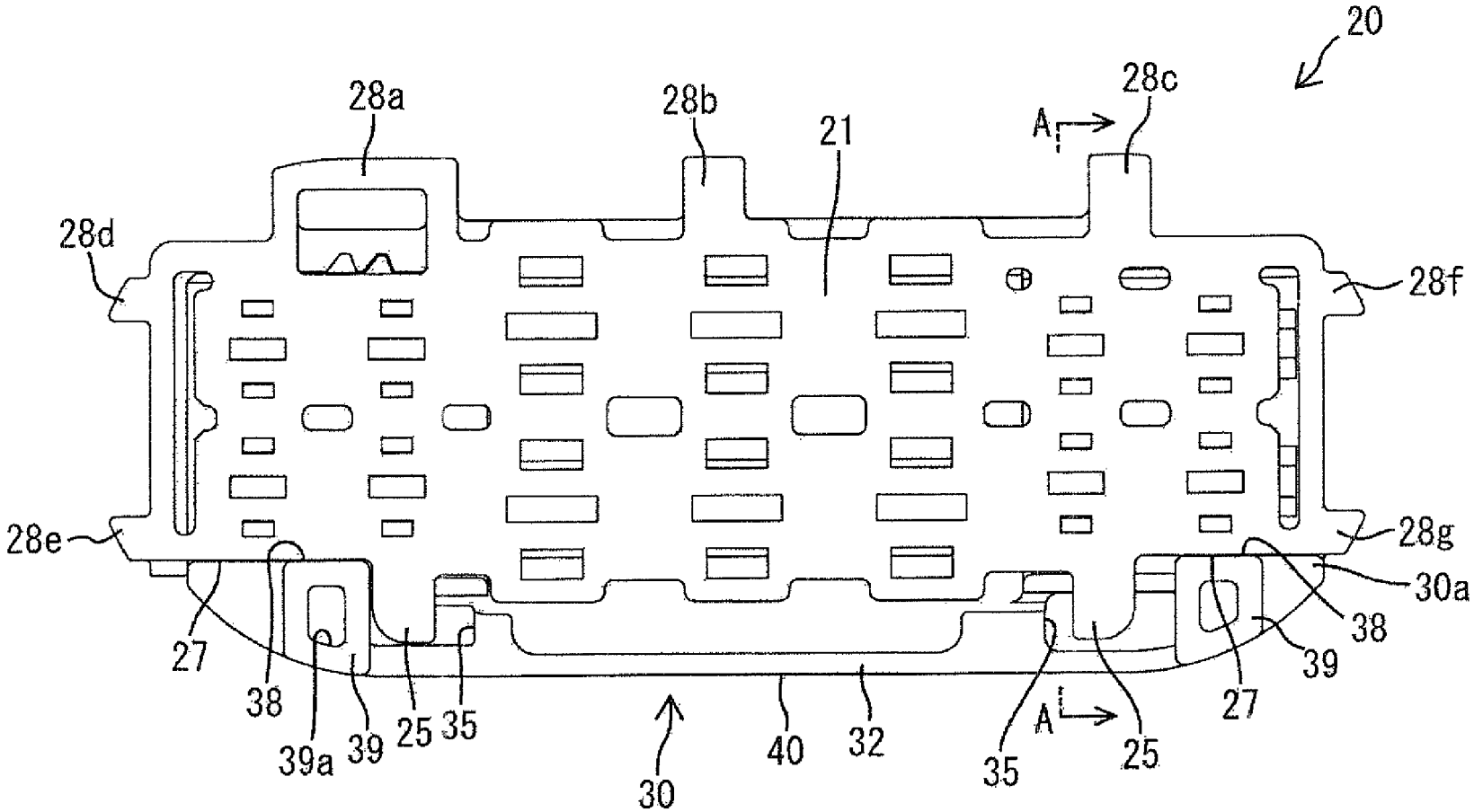
FIG. 2 is a front view showing a retainer mounted in an inner housing.
Figure 3:
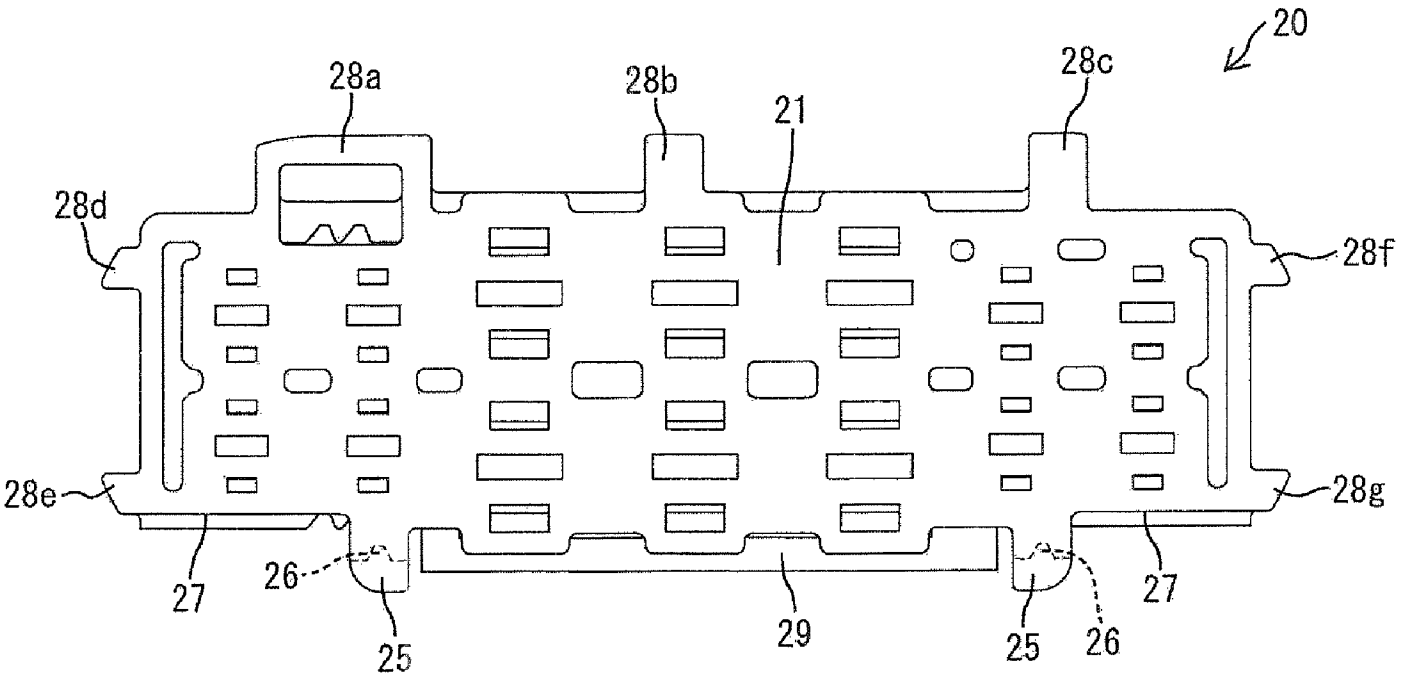
FIG. 3 is a front view of the inner housing.
Figure 4:
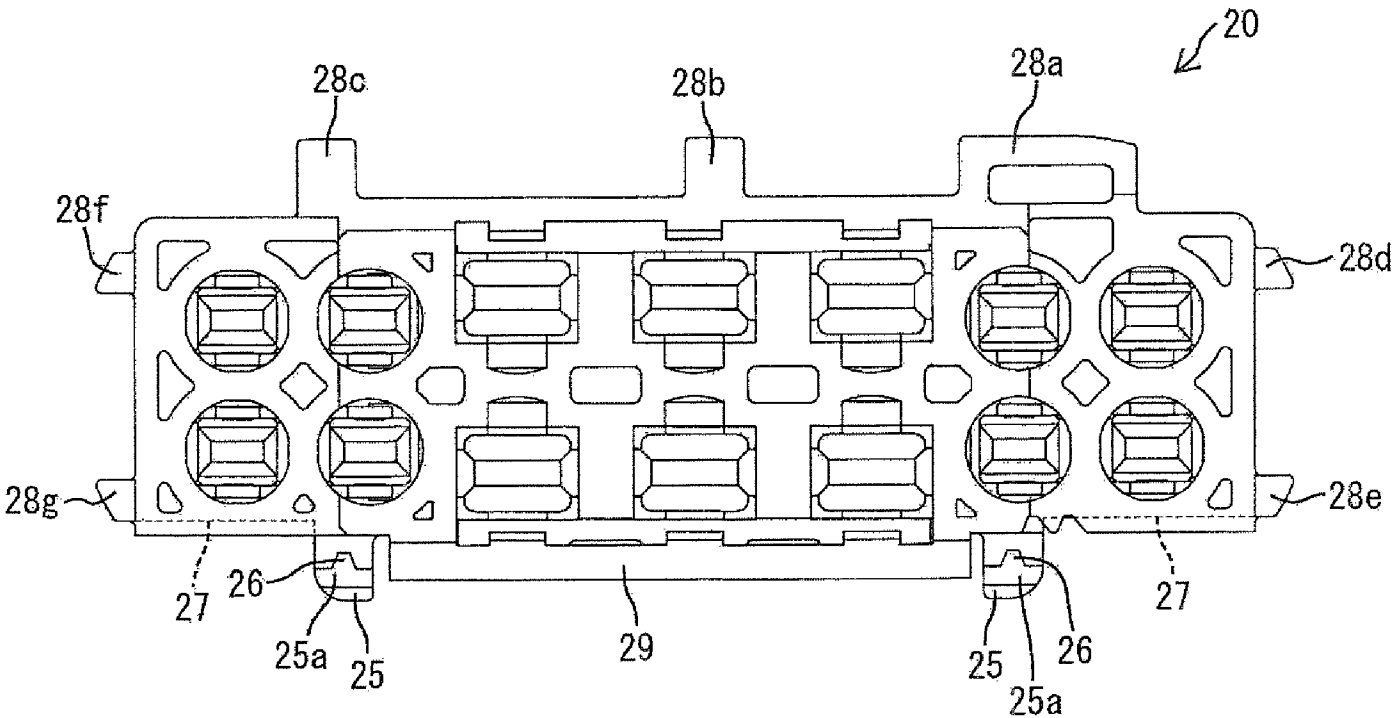
FIG. 4 is a rear view of the inner housing.
Figure 5:
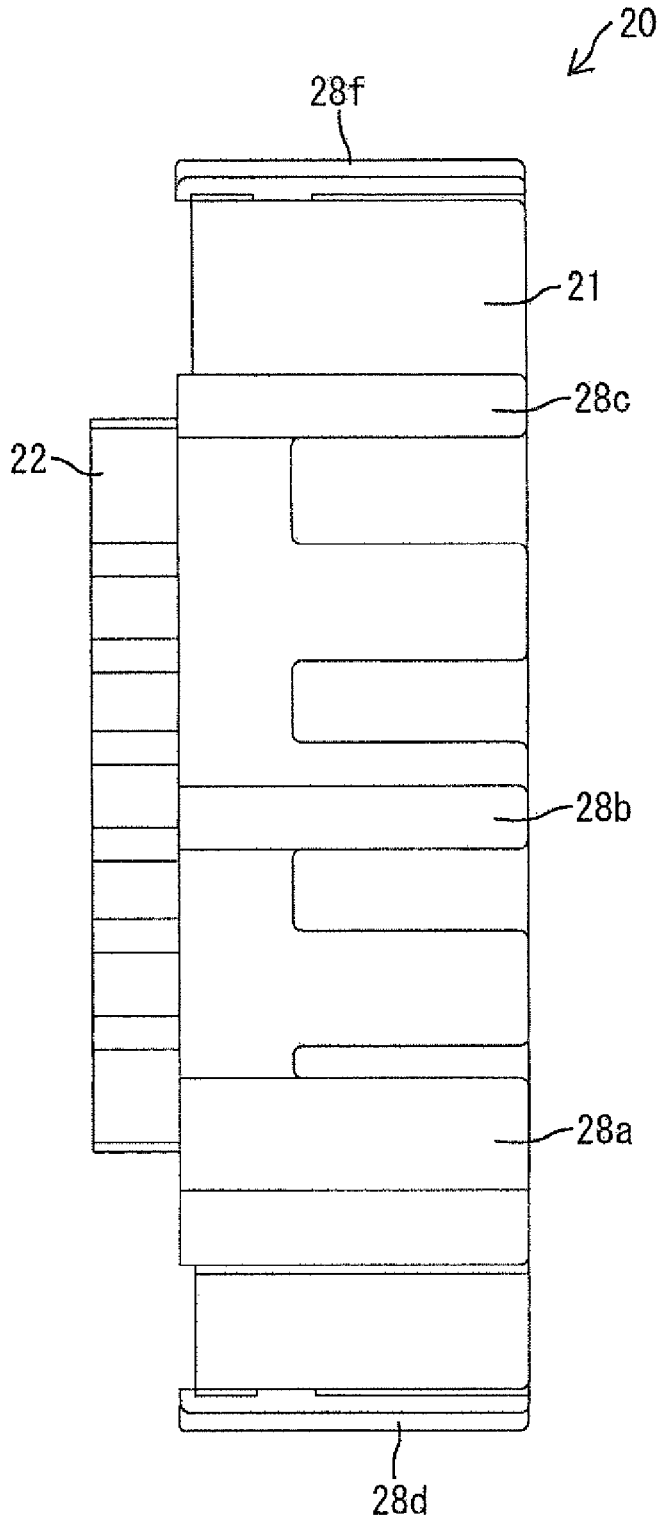
FIG. 5 is a top plan view of the inner housing.
Figure 6:
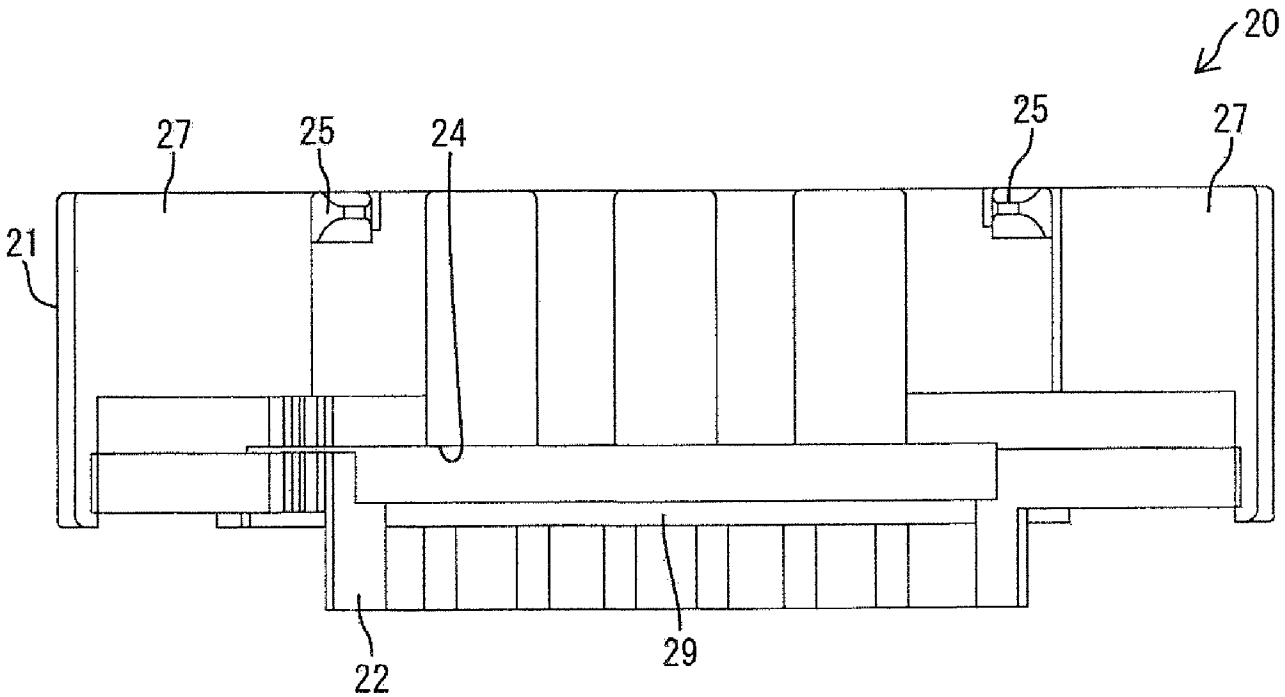
FIG. 6 is a bottom view of the inner housing.
Figure 7:
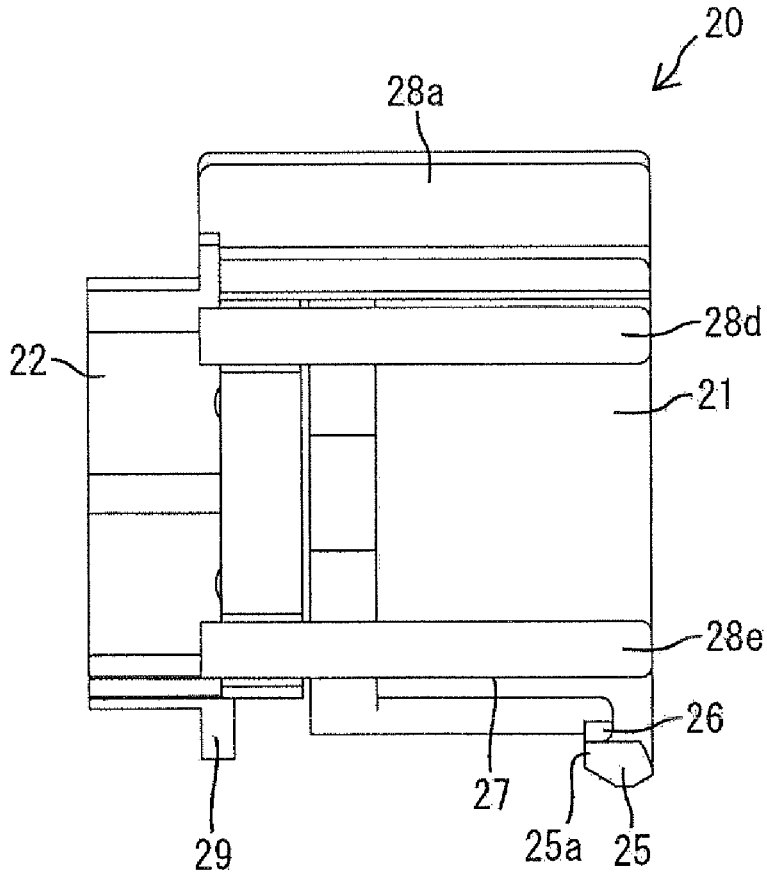
FIG. 7 is a side view of the inner housing.
Figure 8:
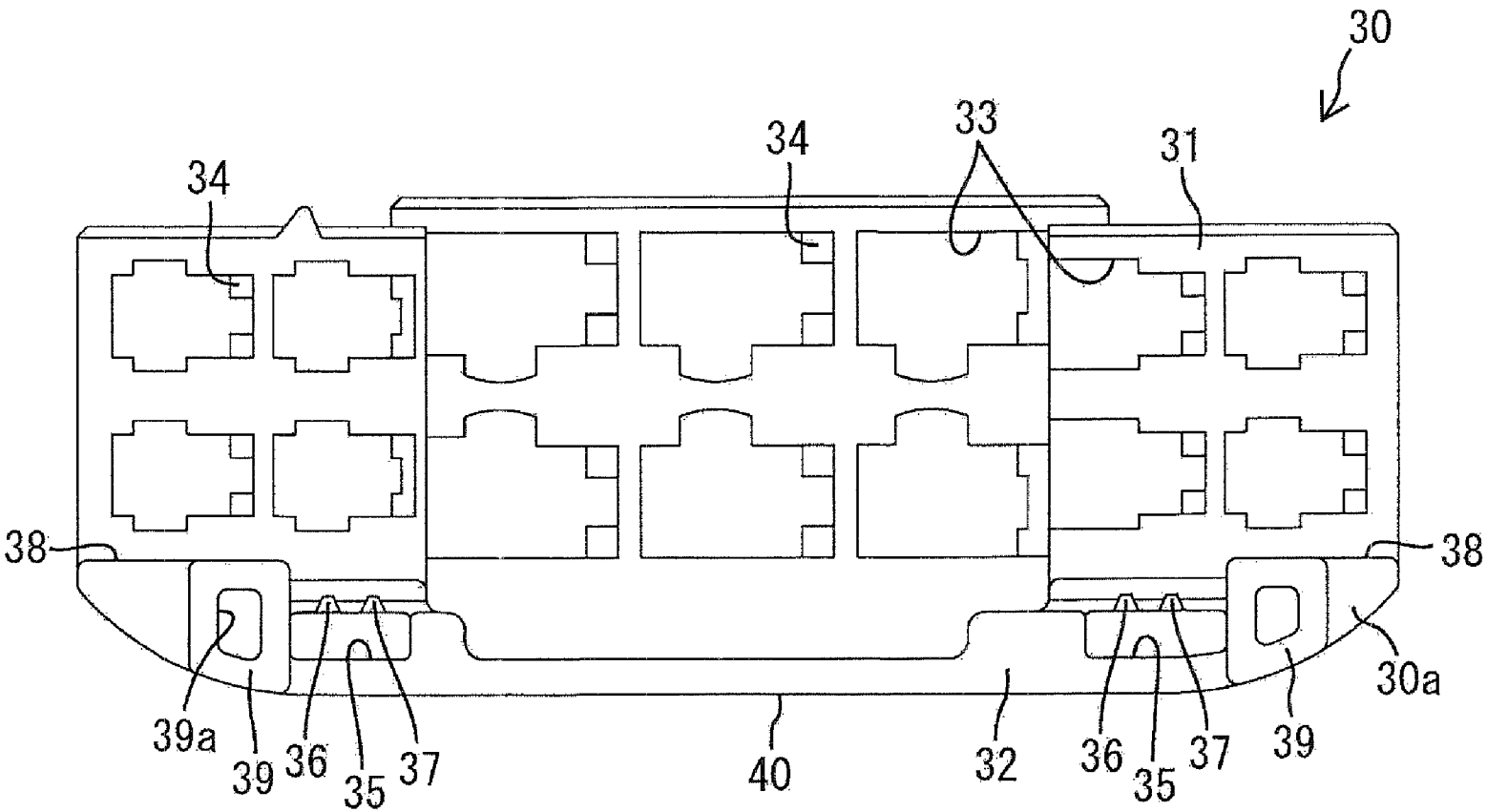
FIG. 8 is a front view of the retainer.

A connector in accordance with the invention has a housing that is identified generally by the numeral 1 in FIGS. 1, 9, 10, 12 and 13. The housing 1 is constructed by assembling an outer housing 10 and an inner housing 20. Terminal fittings 50 are mounted in the housing 1, and a retainer 30 is mounted in the inner housing 20 for retaining the terminal fittings 50.

The outer housing 10 is made e.g. of synthetic resin and includes a wide block-shaped terminal accommodating portion 11 and a receptacle 12 that projects unitarily forward from the outer periphery of the terminal accommodating portion 11. Long narrow rear cavities 13 penetrate the terminal accommodating portion 11 in forward and backward directions. A connection space 14 is formed in the outer housing 10 by recessing the front surface of the terminal accommodating portion 11. The connection space 14 is a wide rectangular opening in the back end of the receptacle 12, and the rear cavities 13 open in the back end surface of the connection space 14. The connection space 14 is in an intermediate part of the terminal accommodating portion 11 with respect to the vertical and lateral directions.

The inner peripheral surface of the receptacle 12 includes left and right substantially semicircular surfaces 15. A substantially horizontal upper flat surface 17*a* is smoothly continuous with upper ends of the semicircular surfaces 15. A substantially horizontal lower flat surface 17*b* is substantially parallel to the upper flat surface 17*a* and is smoothly continuous with the bottom ends of the semicircular surfaces 15. A first substantially quarter-circular area 16*a* forms the upper half of each semicircular surface 15 and a second substantially quarter-circular area 16*b* forms the lower half of each semicircular surface 15. A distance between the flat surfaces 17*a*, 17*b* is longer than a vertical dimension of the connection space 14, and lateral dimensions of the flat surfaces 17*a*, 17*b* are smaller than a lateral dimension of the connection space 14.

The inner housing 20 is made e.g. of synthetic resin and includes a wide block-shaped housing main body 21 and a wide block-shaped fitting 22 that projects back from the rear end surface of the housing main body 21. The fitting 22 is vertically and horizontally smaller than the housing main body 21. Additionally, the fitting 22 is located below the vertical center of the housing main body 21, and the lower surface of the fitting 22 is at substantially the same height as the bottom surface of the housing main body 21. Further, the fitting 22 is located substantially in the lateral center of the housing main body 21.

Front cavities 23 penetrate the inner housing 20 in forward and backward directions and in an arrangement corresponding to the rear cavities 13. The front ends of the front cavities 23 open in the front end surface of the housing main body 21.

The rear ends of the front cavities 23 open in the rear end surface of the housing main body 21 or the rear end surface of the fitting 22 depending on their formation positions.

A multi-level slit-shaped accommodation space 24 is formed in the bottom surface of the housing main body 21 and defines a long narrow slit that extends substantially orthogonal to an inserting direction ID of the terminal fittings 50 into the inner housing 20. The accommodation space 24 communicates with all of the front cavities 23 along the rear end surface of the housing main body 21 in forward and backward directions. The retainer 30 can be assembled 50 through a window-shaped opening of the accommodation space 24 and can be inserted into the accommodation space 24 in the direction substantially orthogonal to the inserting direction of the terminal fittings.

Two locks 25 project down from laterally spaced positions at the front end of the bottom surface of the housing main body 21 for holding the retainer 30 assembled with the inner housing 20. Bottom ends of the locks 25 project back to define to define restricting projections 25*a*. Thus, each lock 25 defines an L-shape when viewed sideways in a direction orthogonal to an assembling direction of the inner and outer housings 20 and 10. A substantially triangular locking projection 26 is formed on the upper surface of a backward projecting part of each lock 25.

Substantially rectangular guide surfaces 27 are defined at the opposite ends of the bottom surface of the housing main body 21 in an area before the opening of the accommodation space 24. The guide surfaces 27 extend parallel to the assembling direction of the inner housing 20 with the outer housing 10 and the lower substantially flat surface 17*b* of the receptacle 12. Additionally, the guide surfaces 27 are substantially at right angles to the assembling direction of the retainer 30 into the inner housing 20 and substantially parallel to a moving direction MD of the retainer 30 between a partial locking position 1P and a full locking position 2P. The retainer 30 is guided by the guide surfaces 27 to move laterally along the moving direction MD between a partial locking position 1P and a full locking position 2P.

First, second and third ribs 28*a*, 28*b* and 28*c* project up from the top surface of the housing main body 21 and extend continuously from the rear end to the front end of the housing main body 21 parallel to the assembling direction of the inner housing 20 into the receptacle 12. The first to third ribs 28*a* to 28*c* are separated in the lateral direction. More particularly, the first rib 28*a* is near the left side of the housing main body 21, the second rib 28*b* is in the lateral center of the housing main body 21 and the third rib 28*c* is near the right side of the housing main body 21 when viewed from the front. The second and third ribs 28*b*, 28*c* have substantially equal widths and are narrower than the first rib 28*a*. A left half area of the upper surface of the first rib 28*a* slopes down towards the left and is arcuate with substantially the same curvature as the semicircular surface 15.

Fourth to seventh ribs 28*d* to 28*g* project laterally from the opposite left and right surfaces of the housing main body 21 and extend from the rear end to the front end of the housing main body 21 substantially parallel to the assembling direction of the inner housing 20 into the receptacle 12. The fourth rib 28*d* is at the top of the left surface of the housing main body 21, the fifth rib 28*e* is at the bottom of the left surface of the housing main body 21, the sixth rib 28*f* is at the top of the right surface of the housing main body 21 and the seventh rib 28*g* is at the bottom of the right surface of the housing main body 21 when viewed from the front. Projecting surfaces of the fourth to seventh ribs 28*d* to 28*g* are arcuate with the same curvature as the semicircular surfaces 15.

A guide rib 29 is formed on the bottom surface of the housing main body 21 and extends laterally substantially along the rear edge of the opening of the accommodation space 24. The guide rib 29 is at substantially at right angles to both the assembling direction (upward direction) of the retainer 30 into the inner housing 20 and the inserting direction ID (forward direction) of the terminal fittings 50 into the inner housing 20 and substantially parallel to the moving direction MD of the retainer 30 between the partial locking position 1P and the full locking position 2P. The guide rib 29 guides the retainer 30 between the partial locking position 1P and the full locking position 2P.

The retainer 30 is made unitarily e.g. of synthetic resin and has a substantially planar lattice-shaped main body 31 aligned at substantially right angles to the assembling direction of the inner housing 20. A substantially plate-like extension 32 projects forward from the bottom end edge of the main body 31 substantially parallel with the assembling direction. The main body 31 has through holes 33 corresponding to the front cavities 23, and retaining portions 34 are formed on the inner peripheral surfaces of the respective through holes 33 for engaging the terminal fittings 50. Recesses 35 are formed at opposite left and right sides of the front end surface of the plate-like extension 32. A partial locking groove 36 and a full locking groove 37 are formed substantially side by side in the lateral direction on the ceiling surface of each recess 35.

Guidable surfaces 38 are defined at the opposite left and right sides of the upper surface of the plate-like extension 32 and extend substantially parallel with the assembling direction of the inner and outer housings 20 and 10 and parallel with the flat surfaces 17*a*, 17*b*. The guidable surfaces 38, similar to the guide surfaces 27, are substantially at right angles to the upward assembling direction of the retainer 30 into the inner housing 20 and substantially parallel to the moving direction MD of the retainer 30 between the partial locking position 1P and the full locking position 2P.

Operable portions 39 project forward from the left and right sides of the plate-like extension 32 at positions laterally adjacent to the recesses 35. Operation holes 39*a* are formed in the operable portions 39 and open in the front end surfaces of the operable portions 39. The leading ends of long narrow jigs (not shown) can be inserted into the receptacle 12 from the front and can enter the operation holes 39*a*. The jigs are operated in the operation holes 39*a*, to move the retainer 30 along the moving direction MD between the partial locking position 1P and the full locking position 2P.

A slide contact surface 40 extends across the bottoms of the plate-like extension 32 and the operable portions 39. Opposite left and right sides of the slide-contact surface 40 are arcuate with substantially the same curvature as the semicircular surfaces 15, and an area of the slide-contact surface 40 between the arcuate areas is substantially flat and parallel to the second flat surface 17*b*.

A slide-contact rib 41 extends laterally along the rear end edge of the extension 32 at the bottom of the main body 31 and projects backward. The slide-contact rib 41 is substantially at right angles to both the upward assembling direction of the retainer 30 into the inner housing 20 and the forward inserting direction ID of the terminal fittings 50 into the inner housing 20 and is substantially parallel to the moving direction MD of the retainer 30 between the partial locking position 1P and the full locking position 2P.

The length of the retainer 30 in the moving direction MD from the partial locking position 1P to the full locking position 2P is shorter than the length of the inner housing 20 in the lateral direction.

Each terminal fitting 50 is a male terminal fitting that is long and narrow in forward and backward directions substantially. The male terminal fitting 50 has a box 51, a tab 52 that projects unitarily forward from the box 51 and a wire crimping portion 53 that is continuous with the rear end of the box portion 51. A wire is electrically connected with the wire crimping portion 53.

Figure 9:
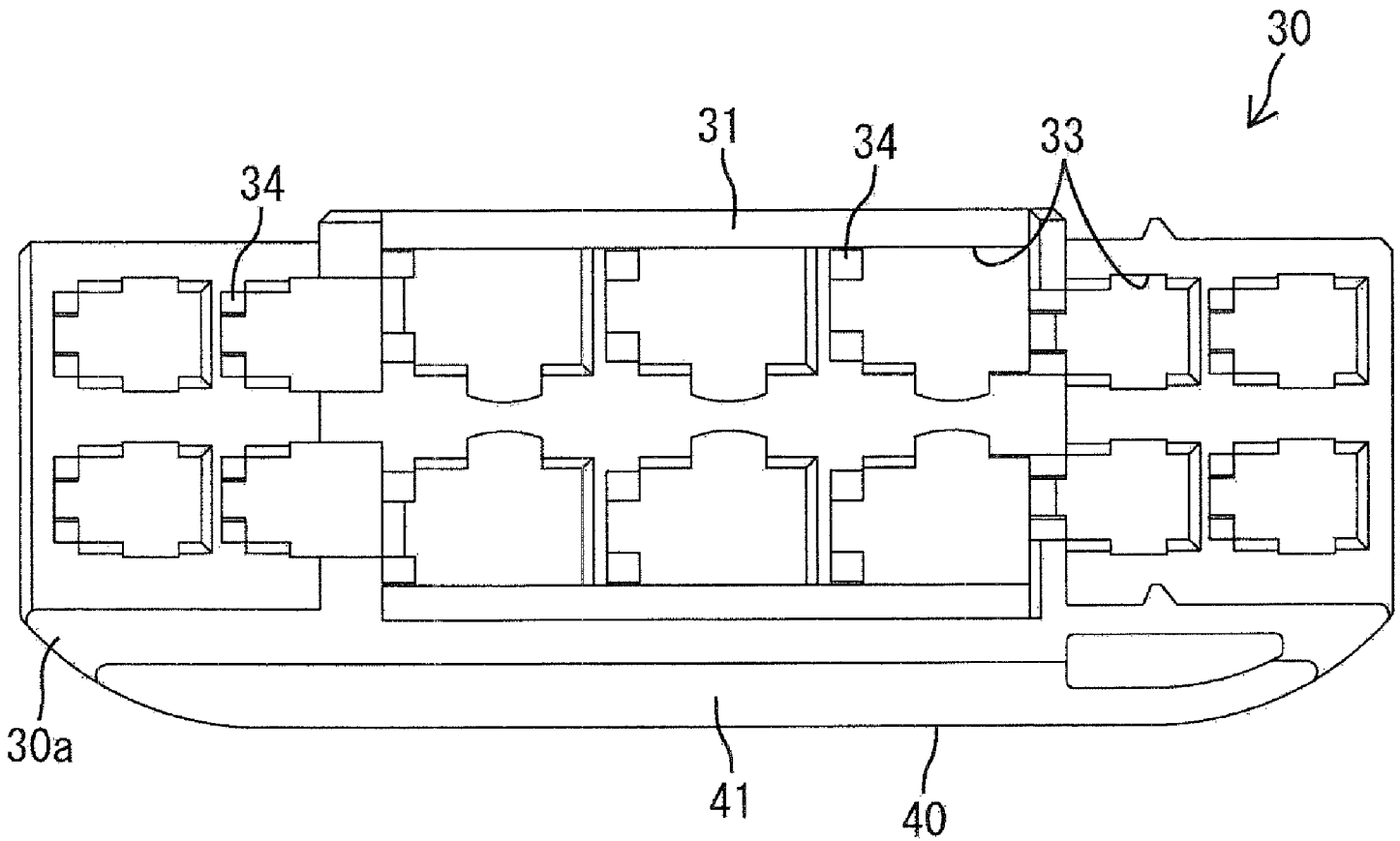
FIG. 9 is a rear view of the retainer.
Figure 14:
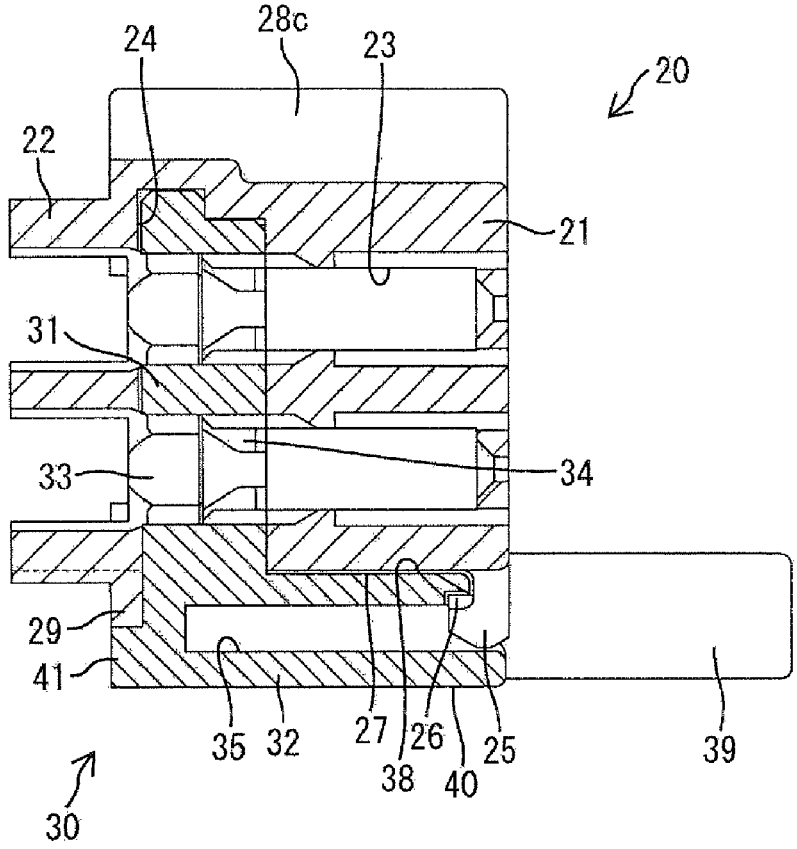
FIG. 14 is a section along A-A of FIG. 2.
Figure 15:
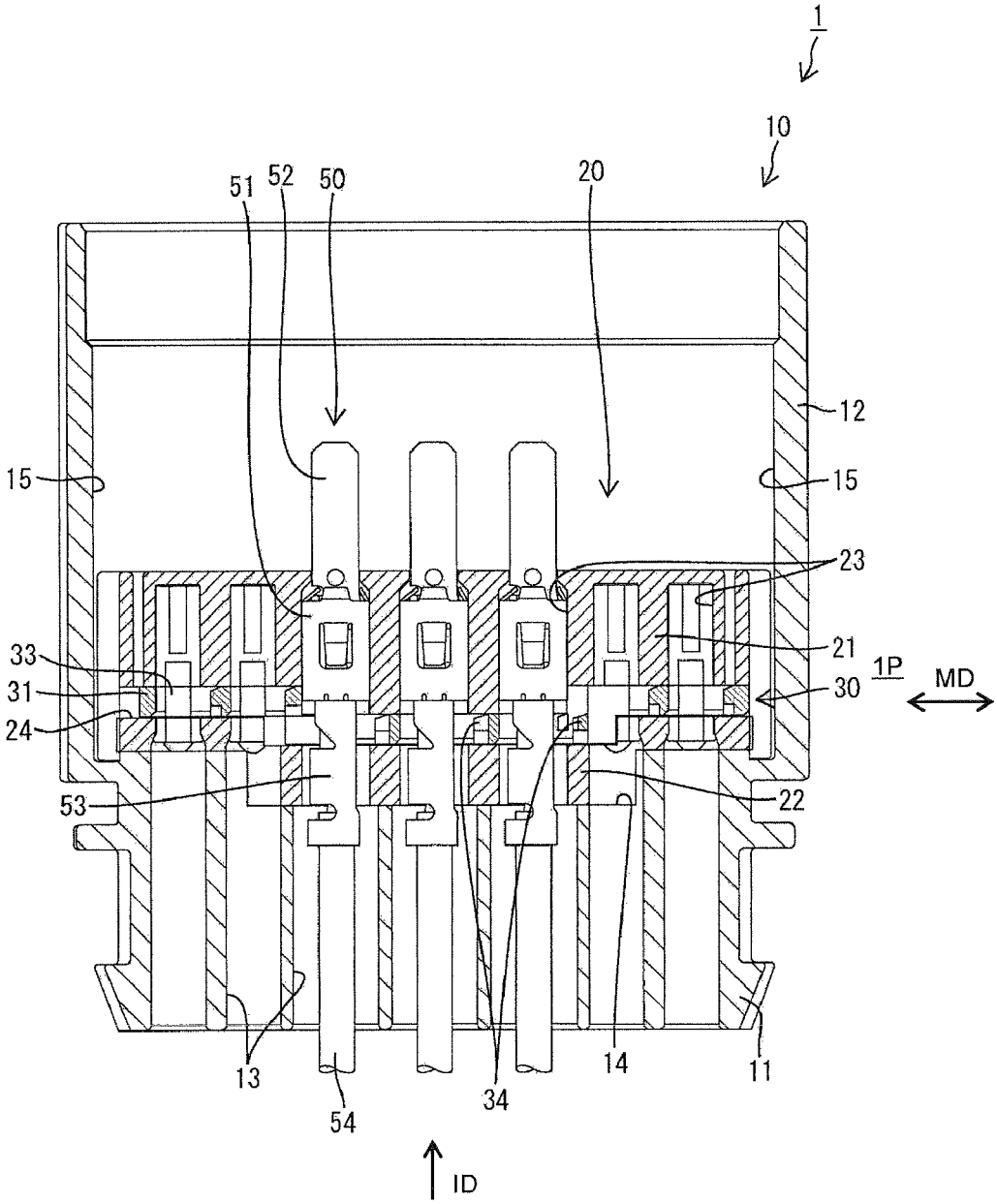
FIG. 15 is a horizontal section showing a state where the retainer is mounted at a partial locking position (first position) in the inner housing.
Figure 16:
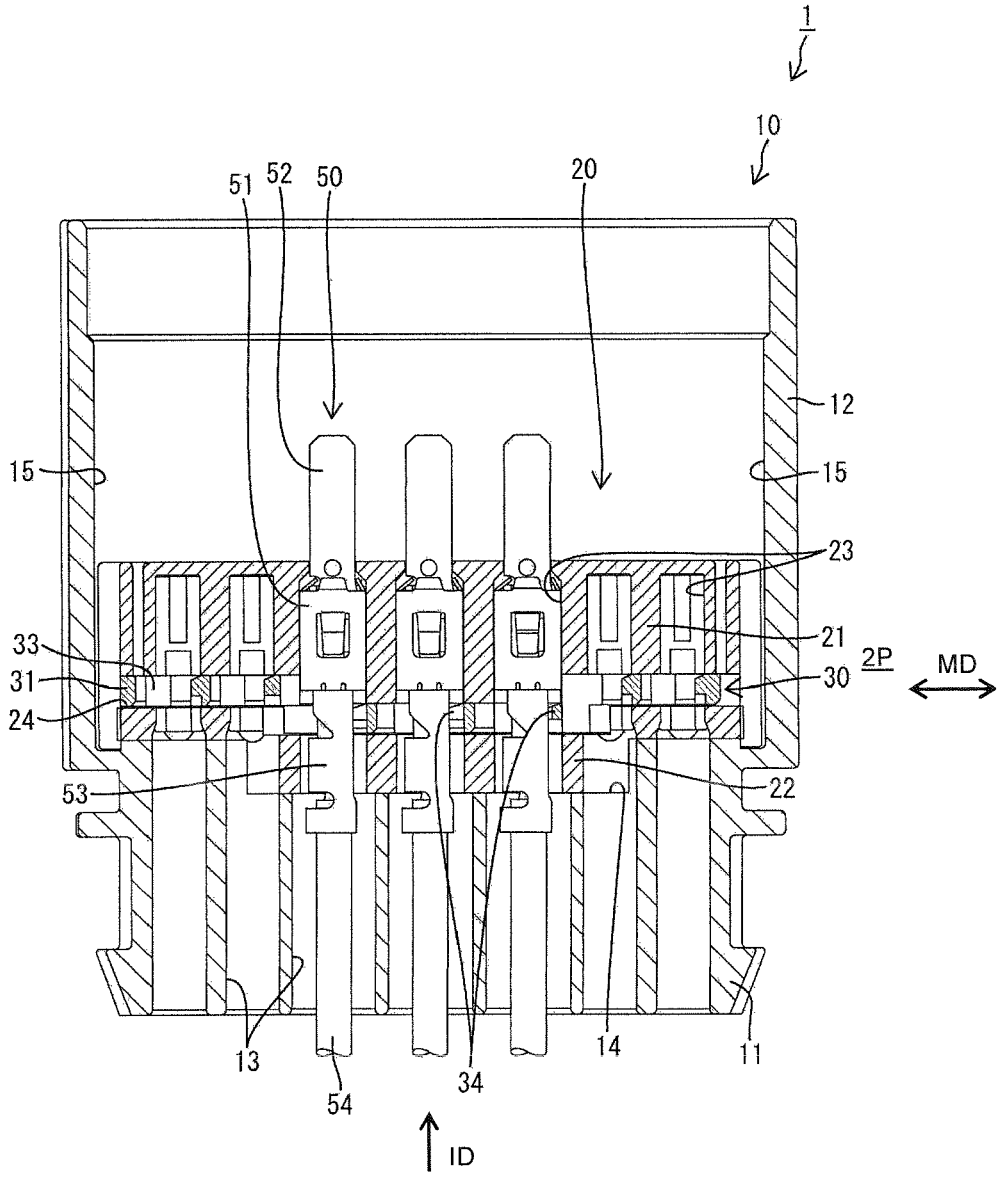
FIG. 16 is a horizontal section showing a state where the retainer is mounted at a full locking position (second position) in the inner housing.
Figure 17:
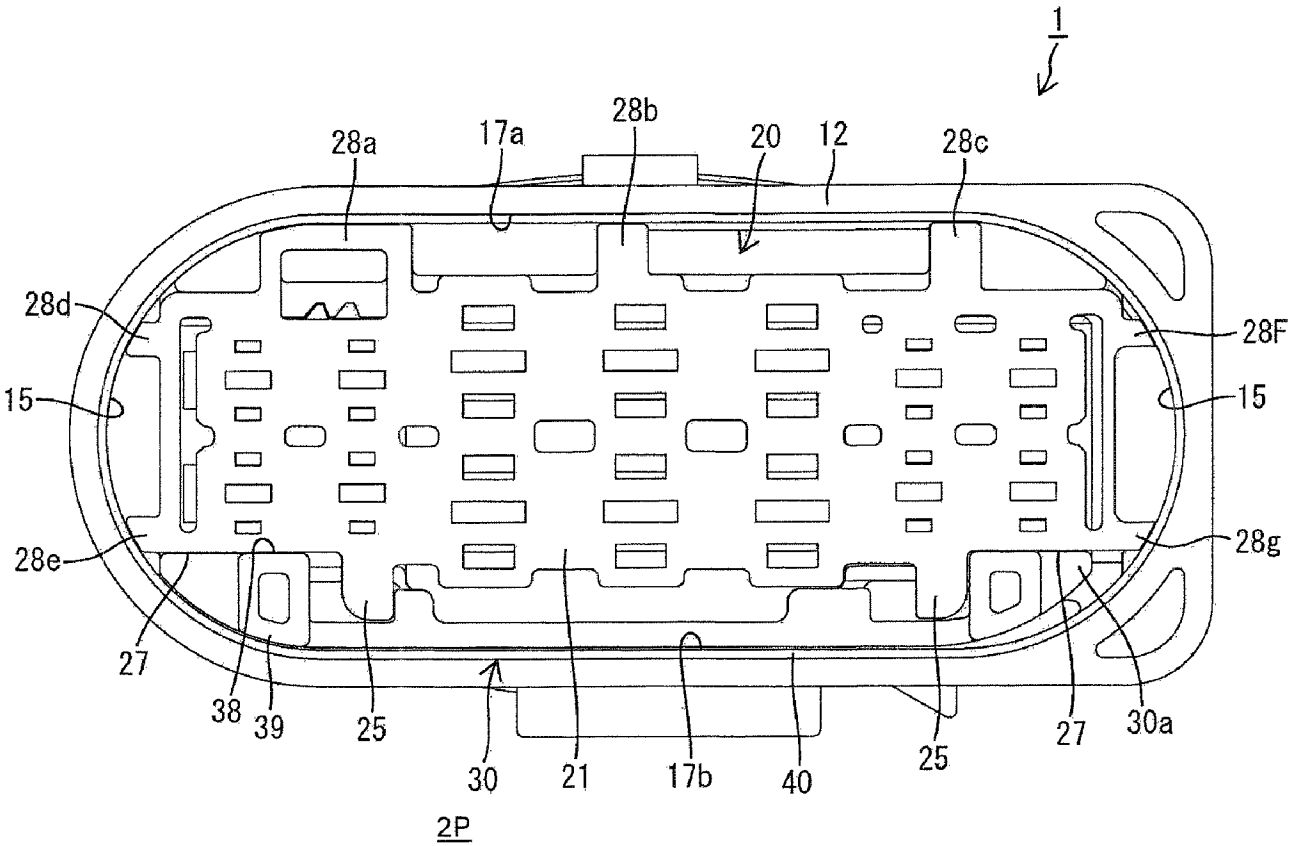
FIG. 17 is a front view showing a retainer held at a partial locking position in an inner housing in a second embodiment.

The connector is assembled by first inserting the retainer 30 into the inner housing 20 so that the main body 31 is fit into the accommodation space 24, as shown in FIG. 9. In the mounting process, the upper walls of the recesses 35 resiliently deform the locks 25 forward. The partial locking grooves 36 engage the locking projections 26 to hold the mounted retainer 30 at a partial locking position 1P and to prevent the retainer 30 from moving laterally towards a full locking position 2P. The main body 31 is fit in the accommodation space 24 with the retainer 30 held at the partial locking position 1P. Thus, the retainer 30 cannot displace or incline in forward and backward directions with respect to the inner housing 20. Further, the guidable surfaces 38 of the retainer 30 achieve surface contact with the guide surfaces 27 of the inner housing 20 from below and the backward projecting parts of the locks 25 of the inner housing 20 engage the upper walls of the recesses 35 from below. Additionally, the slide-contact rib 41 is engaged with the guide rib 29 from below, and the restricting projections 25*a* of the locks 25 of the inner housing 20 are engaged with the upper walls of the recesses 35 from below. Thus, relative vertical displacements of the retainer 30 with respect to the inner housing 20 are prevented. Furthermore, the slide-contact surface 40 across the plate-like extension 32 at the bottom end of the retainer 30 is below the bottom surface of the housing main body 21 of the inner housing 20. Further, an end 30*a* (right end in FIG. 14) of the retainer 30 at a partial locking position side in the moving direction MD from the partial locking position 1P to the full locking position 2P is closer to a full locking position side (left in FIG. 14) than the right outer surface (ribs 28*f*, 28*g*) of the inner housing 20. Thus, the retainer 30 cannot displace vertically relative to the inner housing 20 along the assembling direction. Further, the plate-like extension 32 of the retainer 30 is positioned between the locks 25 and the guide rib 29 in forward and backward directions.

Figure 10:
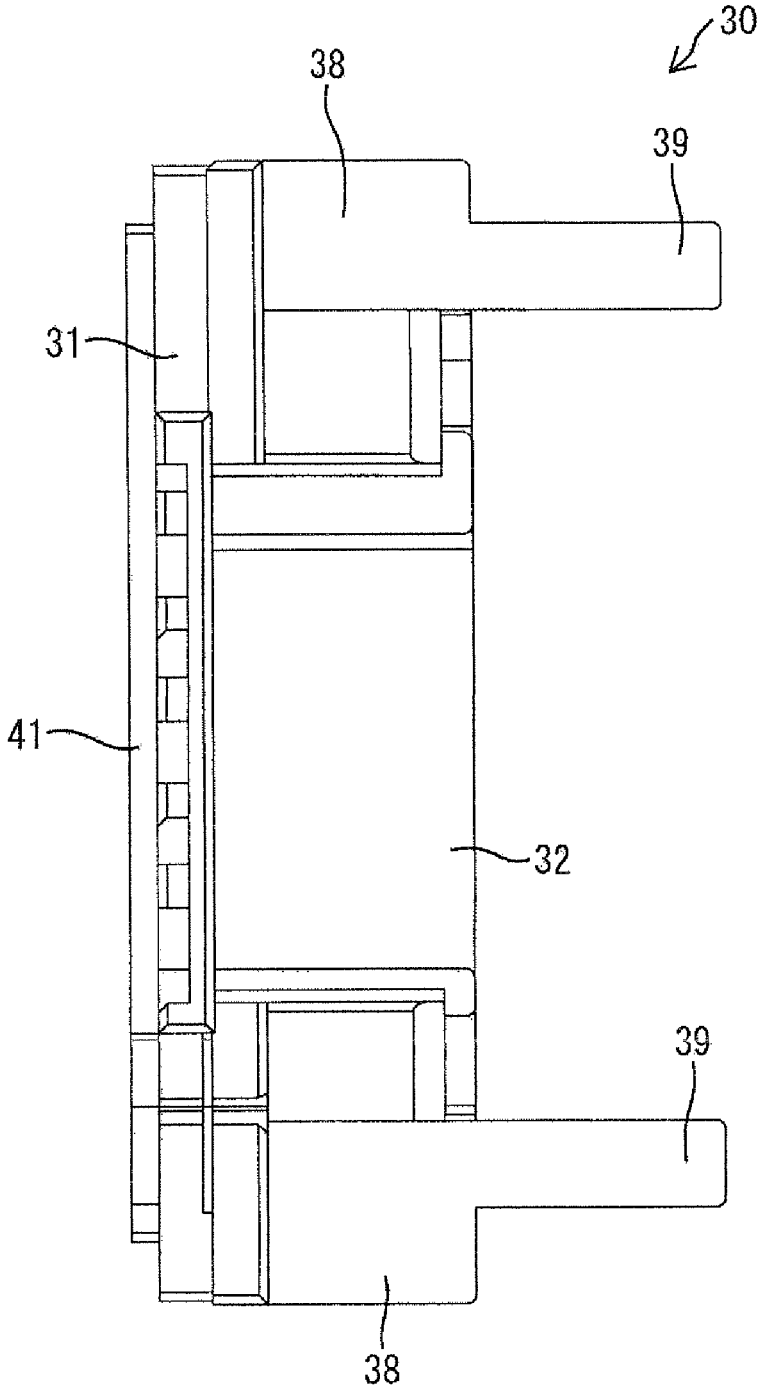
FIG. 10 is a top plan view of the retainer.
Figure 11:
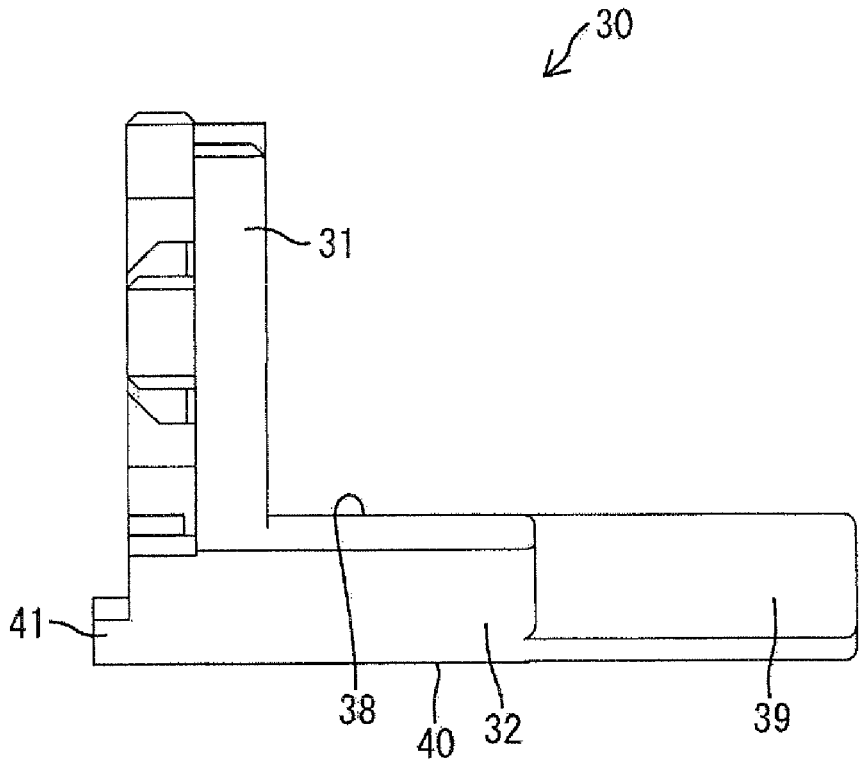
FIG. 11 is a side view of the retainer.

The inner housing 20, with the retainer 30 held therein at the partial locking position 1P, is assembled with the outer housing 10. More particularly, the inner housing 20 is inserted into the receptacle 12 from the front. Thus, as shown in FIGS. 1 and 10, the upper projecting surfaces of the first, second and third ribs 28*a*, 28*b* and 28*c* slide in surface contact on the first flat surface 17*a* of the receptacle 12. The left area of the first rib 28*a* slides in contact with the upper end of the upper left quarter-circular area 16*a* from below. Further, the slide-contact surface 40 on the lower surface of the retainer 30 slides in surface contact on the second flat surface 17*b*. The projecting end surface of the fourth rib 28*d* slides on the upper left quarter-circular area 16*a* while being held obliquely in surface contact from the lower right. The projecting end surface of the fifth rib 28*e* slides on the lower left quarter-circular area 16*b* while being held obliquely in surface contact from the upper right. The projecting end surface of the sixth rib 28*f* slides on the upper right quarter-circular area 16*a* while being held obliquely in surface contact from the left lower. Additionally, the projecting end surface of the seventh rib 28*g* slides on the lower right quarter-circular area 16*b* while being held obliquely in surface contact from the upper left. The first to seventh ribs 28*a* to 28*g* slide in contact with the inner peripheral surface of the receptacle 12 to position the inner housing 20 in the receptacle 12 while being prevented from making relative movements in the vertical and lateral directions orthogonal to the assembling direction.

The fitting 22 is fit into the connection space 14 as the inner housing 20 is fit towards the back of the receptacle 12. At this time, the inner housing 20 is positioned in the receptacle 12 with respect to the vertical and lateral directions. Thus, the fitting 22 fits smoothly into the connection space 14 without the peripheral edge of the fitting 22 interfering with the opening edge of the connection space 14 at the back end of the receptacle 12. The rear surface of the housing main body 21 contacts the back end surface of the receptacle 12 and is stopped at a front limit position when the inner housing 20 reaches a proper assembled position. The inner housing 20 is held assembled with the outer housing 10 by unillustrated locking means or friction between the outer peripheral surface of the fitting 22 and the inner peripheral surface of the connection space 14. In this way, the connector housing 1 is assembled.

Figure 12:
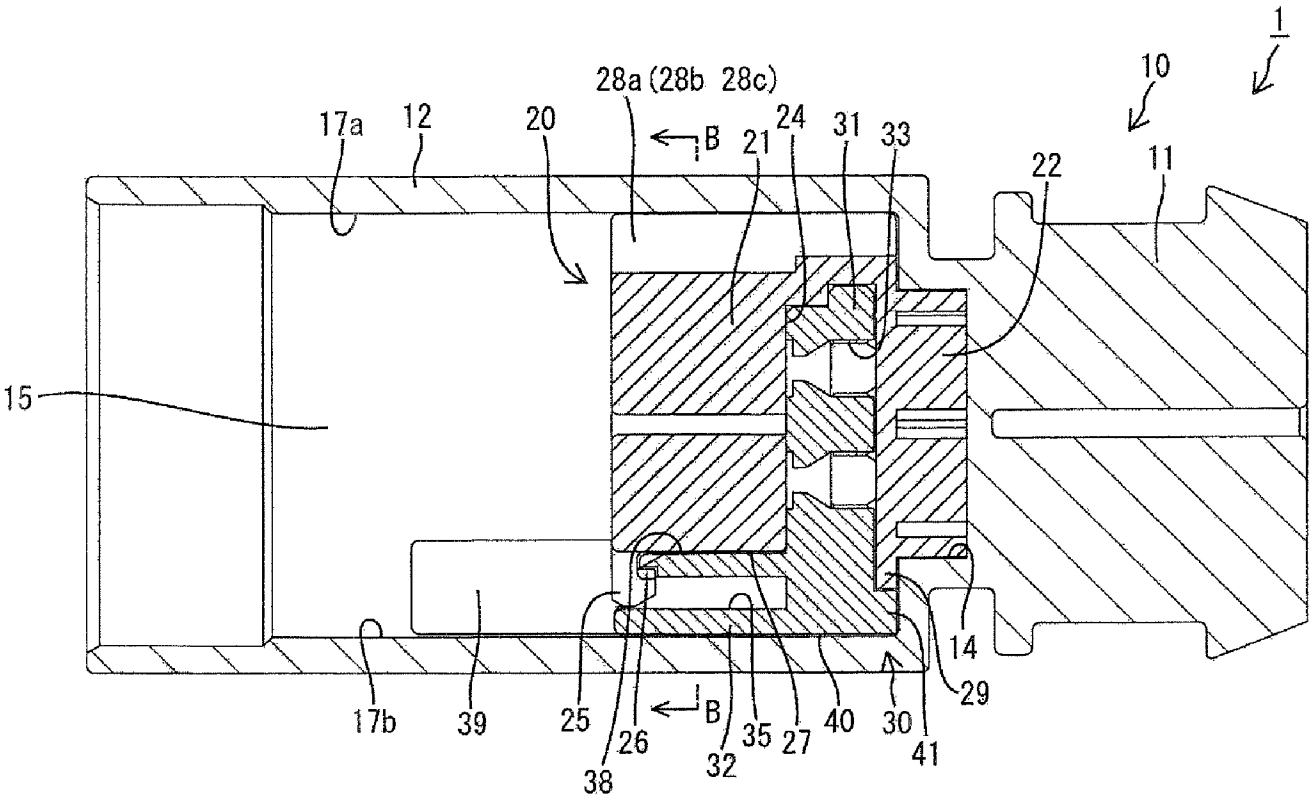
FIG. 12 is a vertical section showing the inner housing assembled with an outer housing.
Figure 13:
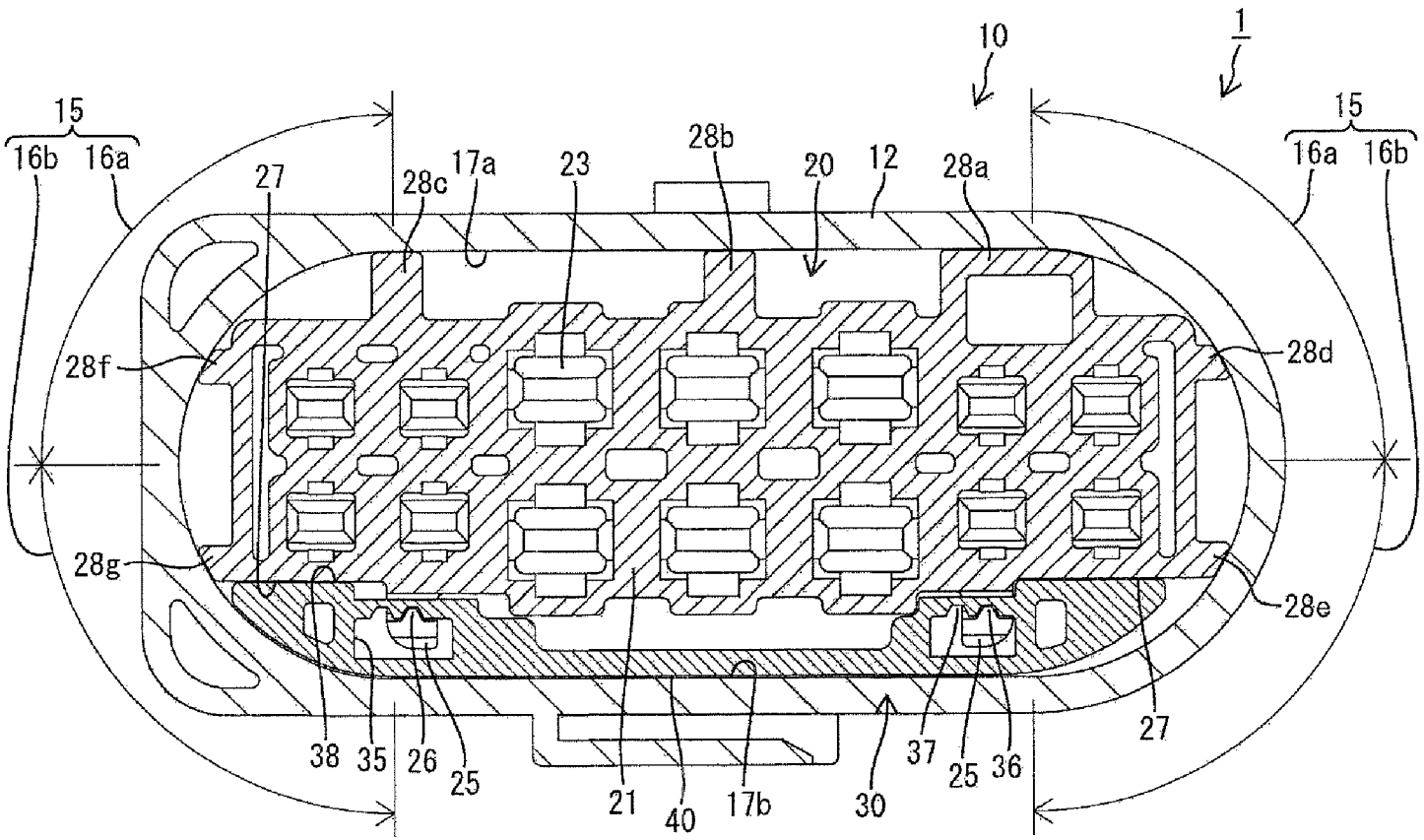
FIG. 13 is a section along B-B of FIG. 12.

Corresponding front and rear cavities 23, 13 communicate in forward and backward directions when the inner and outer housings 20 and 10 are assembled to define spaces for accommodating the terminal fittings 50. The retainer 30 is held at the partial locking position 1P. Thus, the retaining portions 34 of the through holes 33 are retracted from the insertion areas of the front cavities 23 for the terminal fittings 50. In this state, the terminal fittings 50 can be inserted into the respective rear cavities 13 from behind and along an insertion direction ID. The tabs 52 project forward from the front end surface of the housing main body 21 to be surrounded by the receptacle 12 when the terminal fittings 50 reach proper insertion positions, and the boxes 51 are located in the front cavities 23, as shown in FIG. 12. The properly inserted terminal fittings 50 are retained primarily by locking lances.

Lateral pressing forces are exerted on the operable portions 39 of the retainer 30 by jigs or the like after all of the terminal fittings 50 have been inserted. Thus, the retainer 30 is displaced along a moving direction MD from the partial locking position 1P to the full locking position 2P. Movement of the retainer 30 to the full locking position is guided by sliding contact of the slide-contact surface 40 and the lower flat surface 17*b*, and also by the sliding contact of the guide surfaces 27 and the guidable surfaces 38 and the sliding contact of the guide ribs 29 and the slide-contact ribs 41. The retainer 30 is held at the full locking position 2P by the engagement of the full locking grooves 37 and the locking projections 26. The retaining portions 34 of the retainer 30 are located in the front cavities 23 and engage the lateral edges of the boxes 51 of the terminal fittings 50 from behind when the retainer 30 is at the full locking position 2P to achieve reliable secondary locking of the terminal fittings 50.

As described above, the first to seventh ribs 28*a* to 28*g* on the outer peripheral surface of the inner housing 20 slide in contact with the inner peripheral surface of the receptacle 12. Thus, the inner housing 20 is positioned in the receptacle 12 and cannot displace in directions intersecting the assembling direction into the receptacle 12. Therefore, the fitting 22 of the inner housing 20 is fit reliably into the connection space 14.

The first to seventh ribs 28*a* to 28*g* extend substantially parallel to the assembling direction of the inner housing 20 into the receptacle 12. Thus, an oblique posture of the inner housing 20 with respect to the assembling direction is prevented.

The outer surface of the retainer 30 mounted in the inner housing 20 projects from the outer surface of the inner housing 20 and the outer slide-contact surface 40 of the projecting part of the retainer 30 from the inner housing 20 slides in contact with the inner peripheral surface of the receptacle 12.

The inner housing 20 is positioned utilizing the first to seventh ribs 28*a* to 28*g* and the retainer 30. Thus, the number of the ribs formed on the inner housing 20 is reduced and consequently the shape of the outer peripheral surface of the inner housing 20 is simplified.

The housing main body 21 of the inner housing 20 is a block having top and bottom surfaces substantially parallel to each other. The first to third ribs 28*a* to 28*c* are formed on the top surface and the retainer 30 is arranged at the bottom surface. Thus, the vertical orientation of the inner housing 20 can be discriminated easily by confirming the positions of the first to third ribs 28*a*-28*c* and the retainer 30. Accordingly, there is little likelihood that an operator inserts the inner housing 20 into the receptacle 12 in a vertically inverted orientation.

The inner peripheral surface of the receptacle 12 has a substantially elliptical shape by connecting the two left and right semicircular surfaces 15 by the upper and lower parallel flat surfaces 17*a*, 17*b*. The retainer 30 slides in contact with the lower flat surface 17*b* at the lower side. No ribs that slide in contact with the receptacle 12 are formed on the bottom surface of the housing main body 21 where the retainer 30 projects. In such a mode, the inner housing 20 and the retainer 30 could make shaking movements in the vertical direction orthogonal to the flat surfaces 17*a*, 17*b* with respect to the receptacle 12 if an assembling tolerance between the inner housing 20 and the retainer 30 is large and a projecting distance of the retainer 30 from the bottom surface of the housing main body 21 is short. However, the fourth to seventh ribs 28*d* to 28*g* slide in contact with the lower quarter-circular areas 16*b* of the semicircular surfaces 15 at the retainer projecting side and the upper quarter-circular areas 16*a* of the semicircular surfaces 15 at the side substantially opposite to the retainer projecting side. Accordingly, the directions in which the fourth rib 28*d* and fifth rib 28*e* or sixth rib 28*f* and seventh rib 28*g* contact the two quarter-circular areas 16*a*, 16*b* of each semicircular surface 15 are opposite to each other with respect to the vertical direction orthogonal to the flat surfaces 17*a*, 17*b*. Therefore, there is no likelihood of vertical backlashes of the inner housing 20 and the retainer 30 with respect to the receptacle 12.

The moving direction MD of the retainer 30 from the partial locking position 1P to the full locking position 2P intersects the assembling direction of the retainer 30 into the inner housing 20. Thus, even if an external force acts on the outer surface of the retainer 30 in the same direction as the assembling direction, there is no likelihood of moving the retainer 30 from the partial locking position 1P to the full locking position 2P.

The end 30*a* of the retainer 30 at the partial locking position side is closer to the full locking position side than the outer surface of the inner housing 20 when the retainer 30 is at the partial locking position 1P. Thus, even if external matter approaches in a direction to move the retainer 30 to the full locking position 2P, this external matter does not directly contact the end 30*a* of the retainer 30 at the partial locking position side. Therefore, the retainer 30 will not be pushed to the full locking position 2P by external matter.

The inner housing 20 has the locks 25 for engaging the retainer 30 that has been assembled in the inner housing 20. Thus, the retainer 30 is held assembled in the inner housing 20 by the locking action of the locks 25.

The locking projections 26 act as both the partial locking portion for holding the retainer 30 at the partial locking position 1P and the full locking portion for holding the retainer 30 at the full locking position 2P. Thus, the shape of the inner housing 20 can be simplified as compared with the case where the partial and full locking portions are formed separately.

The locking projections 26 on the locks 25 prevent the separation of the retainer 30 from the inner housing 20. Thus, the shape of the inner housing 20 is simplified as compared with the case where the partial locking portion and the full locking portion are formed on parts other than the locks 25.

The connector housing 1 is formed so that the inner housing 20 having the terminal fittings 50 inserted therein is accommodated in the outer housing 10, and the retainer 30 is assembled into the accommodation space 24 formed in the outer peripheral surface of the inner housing 20. The opening area of the accommodation space 24 in the outer peripheral surface of the inner housing 20 is at least partly covered by the outer housing 10. Thus, interference of external matter with the retainer 30 is prevented reliably.

The invention is not limited to the above described and illustrated embodiment. For example, the following embodiments are also embraced by the technical scope of the present invention as claimed.

The ribs are not limited to those extending from the front end to the rear end of the housing main body in parallel with the assembling direction of the inner housing into the receptacle, and may be formed only at the rear end of the housing main body or only at the front end of the housing main body.

The ribs are not limited to those continuously extending from the front end to the rear end of the housing main body and may be divided in forward and backward directions.

The retainer may not project from the outer circumferential surface of the inner housing and the inner housing may be positioned only by the ribs.

Ribs may be formed also on the outer surface of the inner housing at the side where the retainer projects.

The receptacle need not be elliptical.

The ribs may not be held in sliding contact with the flat surface. In this case, vertical and lateral movements of the inner housing can be prevented if the ribs are held in sliding contact with the four quarter-circular areas.

The invention is also applicable to connectors of the type that a retainer is not mounted in an inner housing.

The assembling direction of the retainer into the housing may be oblique to the inserting direction of the terminal fittings.

The housing need not be comprised of inner and outer housings, and may be comprised of a single part. In this case, the accommodation space of the retainer is exposed at the outer surface of the housing.

The end of the retainer at the partial locking position side may project from the outer surface of the housing.

The retainer may be formed so that the outer surface does not slide in contact with the inner peripheral surface of the outer housing.

The retainer may be assembled while being exposed at the front surface of the inner housing. In this case, the retainer can retain the terminal fittings by entering deformation spaces for the locking lances to prevent resilient deformations of the locking lances.

The terminal fittings may be held in the housing only by the action of the retainer without additional locking means on the terminal fittings or the housing.

What is claimed is:

1. A connector, comprising:

an outer housing including a receptacle and a connection space at a back end part of the receptacle an inner housing inserted into the receptacle of the outer housing and at least partly fit in the connection space, the inner housing being configured for holding one or more terminal fittings, ribs being formed on an outer peripheral surface of the inner housing for sliding contact with an inner peripheral surface of the receptacle for preventing relative displacements of the inner housing in directions intersecting an assembling direction with respect to the receptacle; and a retainer mounted in the inner housing, the retainer being movable between a first position for permitting insertion of the terminal fittings and a second position for engaging and retaining the terminal fittings, part of the retainer projecting from the outer peripheral surface of the inner housing, and an outer surface of the part of the retainer projecting from the inner housing being aligned substantially parallel to a moving direction of the retainer between the first and second positions and being in slidable contact with the inner peripheral surface of the receptacle as the inner housing is being inserted into the outer housing and as the receptacle is being moved between the first and second positions.

2. The connector of claim 1, wherein the ribs substantially continuously extend in parallel with an assembling direction of the inner housing into the receptacle.

3. The connector of claim 1, wherein the inner housing has first and second substantially parallel outer surfaces, the ribs being formed on the first outer surface of the inner housing, and the retainer projecting from the second outer surface of the inner housing.

4. The connector of claim 1, wherein:

the inner peripheral surface of the receptacle has a substantially elliptical shape defined by two semicircular surfaces joined by two substantially parallel flat surfaces, the retainer sliding in contact with the flat surfaces, the outer peripheral surface of the inner housing where the retainer projects being free of ribs, and the inner housing being formed with two ribs for each semicircular surface for sliding contact with a quarter-circular area of the semicircular surface at a projecting side of the retainer and a quarter-circular area of the semicircular surface at a side opposite to the retainer projecting side.

5. A connector, comprising:

a housing configured for receiving terminal fittings along an inserting direction; and a retainer to be assembled into the housing in an assembling direction perpendicular to the inserting direction, the retainer assembled in the housing being movable between a first position for permitting insertion of the terminal fittings and a second position for engaging and retaining the terminal fittings, and a moving direction of the retainer between the first position and the second position being perpendicular to both the assembling direction of the retainer into the housing and the inserting direction of the terminal fittings into the housing.

6. The connector of claim 5, wherein an accommodation space is formed in the housing for receiving the retainer, and the housing includes at least one window-shaped opening for permitting the retainer to be assembled into the accommodation space in the direction intersecting the inserting direction of the terminal fittings.

7. The connector of claim 5 wherein the housing includes guide means for guiding the retainer for movement between the first position and the second position.

8. The connector of claim 5, wherein the retainer is sufficiently shorter than the housing in the moving direction of the retainer from the first position to the second position so that no part of the retainer projects beyond the housing in a direction opposite to the moving direction when the retainer is at the first position, whereby external matter is not likely to push the retainer inadvertently from the first position to the second position.

9. The connector of claim 5, wherein the housing is formed with at least one restriction engaging the retainer and configured for preventing separation of the retainer from the housing.

10. The connector of claim 9, wherein the restriction is formed with a first lock configured for engaging the retainer and holding the retainer at the first position and a second lock for engaging the retainer and holding the retainer at the second position.

11. A connector housing including an inner housing configured for receiving terminal fittings along an inserting direction and an outer housing for accommodating the inner housing; and a retainer to be assembled into the housing in a direction intersecting the inserting direction, the retainer assembled in the housing being movable between a first position for permitting insertion of the terminal fittings and a second position for engaging and retaining the terminal fittings, and a moving direction of the retainer between the first position and the second position intersecting both the assembling direction of the retainer into the housing and the inserting direction of the terminal fittings into the housing.

12. The connector of claim 11, wherein an accommodation space is formed in the inner housing and opens to an outer peripheral surface of the inner housing, and an opening area of the accommodation space in the outer peripheral surface of the inner housing being covered at least partly by the outer housing.

13. The connector of claim 11, wherein:

an outer surface of the retainer assembled in the inner housing serves as a slide-contact surface projecting from the outer surface of the housing and having an area substantially parallel to the moving direction from the first position to the second position, and the retainer can be moved from the first position to the second position while bringing the slide-contact surface substantially into sliding contact with the inner peripheral surface of the outer housing.

14. The connector of claim 11, wherein the retainer is formed with at least one operable portion that projects substantially forward at a position in proximity to a front surface of the inner housing, the operable portion being configured for engagement with at least one jig at least partly inserted into the outer housing.

* * * * *